US006326724B1

(12) United States Patent
Däumer et al.

(10) Patent No.: US 6,326,724 B1
(45) Date of Patent: Dec. 4, 2001

(54) GAS-FILLED DISCHARGE GAP ASSEMBLY

(75) Inventors: Wolfgang Däumer, Berlin (DE); Xiangyang Zou; Qin Jifeng, both of Xiaogan (CN)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 09/669,799

(22) Filed: Sep. 26, 2000

Related U.S. Application Data

(63) Continuation of application No. PCT/DE99/00814, filed on Mar. 12, 1999.

(30) Foreign Application Priority Data

Mar. 26, 1998 (DE) ..... 198 14 631

(51) Int. Cl.[7] ..... H01J 63/04

(52) U.S. Cl. ..... 313/484; 313/567; 361/120

(58) Field of Search ..... 313/484, 607, 313/633, 630, 355, 325, 609, 635, 567, 566, 563; 361/120, 115, 127, 123

(56) References Cited

U.S. PATENT DOCUMENTS 5,995,355 * 11/1999 Daeumer ..... 361/120

* cited by examiner

*Primary Examiner*—Michael H. Day
*Assistant Examiner*—Joseph Williams
(74) *Attorney, Agent, or Firm*—Herbert L. Lerner; Laurence A. Greenberg; Werner H. Stemer

(57) ABSTRACT

In gas-filled discharge gaps having a vitreous electrode activation compound formed of several components. In order to prevent excessive fluctuations of the d.c. sparkover voltage $U_{ag}$ under load, potassium silicate and cesium tungstate are provided as base components of the electrode activation compound to sodium silicate, cesium silicate and titanium.

2 Claims, 1 Drawing Sheet

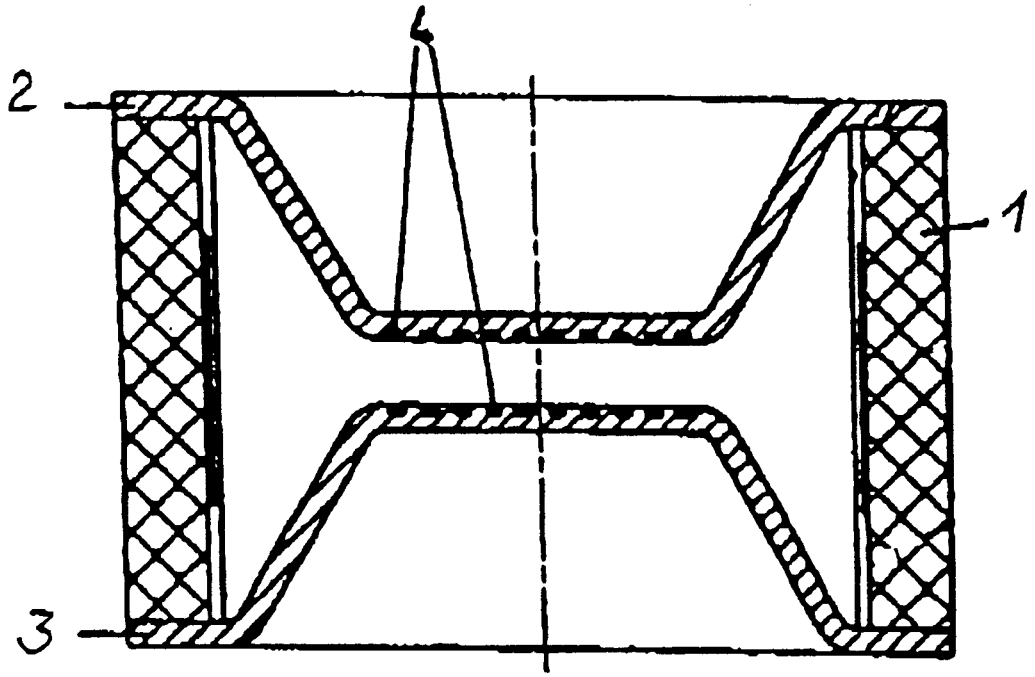
2
1
3

GAS-FILLED DISCHARGE GAP ASSEMBLY

CROSS-REFERENCE TO RELATED APPLICATION

This is a continuation of copending International Application PCT/DE99/00814, filed Mar. 12, 1999, which designated the United States.

BACKGROUND OF THE INVENTION cl FIELD OF THE INVENTION

The invention relates to the field of electronic components and is intended for application in the field of gas-filled discharge gaps having at least two electrodes, in which a vitreous electrode activation compound consisting of several components is applied on at least one of the electrodes in order to guarantee the starting characteristics.

In discharge gaps such as overvoltage arresters or switching spark gaps, in order to guarantee the desired operating behavior for instance starting voltage (particularly d.c. sparkover voltage), time to sparkover, static sparkover voltage, dynamic sparkover voltage, holdover voltage, and glow voltage various measures must be tuned to one another, such as the constructional design of the electrodes, the type and pressure of the gas filling, and the selection of the activation compound that is disposed on the active surfaces of the electrodes. To set the d.c. sparkover voltage $V_s$, it is common to use a vitreous electrode activation compound containing sodium silicate ($Na_2SiO_3$), cesium silicate ($CS_2SiO_3$), and metallic titanium (Ti) as base components and smaller fractions of sodium tetraborate ($Na_2B_4O_7$) and magnesium oxide (MgO) as additives. In those prior art activation compounds, the base component sodium silicate is provided in an amount approximately four to six times greater than the other base components, cesium silicate and titanium. An activation compound of such composition has proven to be out of correspondence with the elevated demands placed on the constancy of the d.c. sparkover voltage under surge current load and alternating current load.

SUMMARY OF THE INVENTION

The object of the invention is to provide a gas-filled discharge gap such as a surge arrester or a switching spark gap with an electrode activation compound comprising the above base components and additives which overcomes the above-noted deficiencies and disadvantages of the prior art devices and methods of this kind, and which modifies the activation compound so as to reduce the rise of the d.c. sparkover voltage $V_s$ under surge current load and to diminish the decline of the d.c. sparkover voltage $V_s$ under alternating current load. With the above and other objects in view there is provided, in accordance with the invention, a gas-filled discharge gap assembly, comprising:

at least two electrodes forming a discharge gap therebetween;

an amount of electrode activation compound on at least one of the electrodes;

the electrode activation compound containing base components of sodium silicate ($Na_2SiO_3$), cesium silicate ($Cs_2SiO_3$), and metallic titanium (Ti); additives in relatively smaller proportions of sodium tetraborate ($Na_2B_4O_7$) and magnesium oxide (MgO); and additional base components, reducing a proportion of the sodium silicate ($Na_2SiO_3$), of potassium silicate ($K_2SiO_3$) and cesium tungstate ($Cs_2WO_4$).

In accordance with a concomitant feature of the invention, the base components are contained in the electrode activation compound in an amount of approximately 1 to 3 parts by weight each, and the additives are contained in the electrode activation compound in an amount of approximately 0.1 to 0.5 parts by weight each.

In other words, the above objects are achieved by adding potassium silicate ($K_2SiO_3$) and cesium tungstate ($Cs_2WO_4$) to the electrode activation compound as additional base components while reducing the proportion of sodium silicate. A compound in which the base components are present in an amount of 1 to 3 parts by weight, and the additives are present in an amount of approximately 0.1 to 0.5 parts by weight, respectively, has proven to be a particularly suitable electrode activation compound.

It has been demonstrated that when such an activation compound is used, under surge current of 10*5 kA, 8/20 $\mu$s the increase of measurement values for the rise of the d.c. sparkover voltage is in the range of less than 20% of nominal voltage. However, the drop of the d.c. sparkover voltage under alternating current of 10*5 A, 1 s duration, is always in the range of less than 20% of the nominal voltage in terms of electrical measurement values. Furthermore, it has been demonstrated that the dynamic sparkover voltage is elevated only negligibly under electrical load, and that the initial measurement yield of a complete lot which is manufactured, finished, and measured under the same conditions is higher than previously. In fact, it is higher both with respect to the maintenance of measurement limits of the starting and operating values and with respect to the occurrence of insulation errors.

Other features which are considered as characteristic for the invention are set forth in the appended claims.

Although the invention is illustrated and described herein as embodied in a gas-filled discharge gap, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a sectional view of an exemplary surge arrester according to the invention.

DESCRIPTION OF THE PREFERRED EMBODIMENT

Referring now to the sole figure of the drawing in detail, there is seen a surge arrester consisting of a ceramic insulator 1 and two electrodes 2 and 3 which have been inserted at the face side. The surfaces of the electrodes 2 and 3 are formed with depressions and they carry an activation compound 4. The activation compound 4 contains sodium silicate, cesium silicate, potassium silicate, cesium tungstate, and metallic titanium as base components. Sodium tetraborate and magnesium oxide are also provided as additives. The individual components are present in the following proportions:

Sodium silicate: approx. 2 to 3 parts by weight;

Potassium silicate: approx. 2 to 3 parts by weight;

Cesium silicate: approx. 1 to 2 parts by weight;

Cesium tungstate: approx. 1 to 2 parts by weight;

Metallic titanium: approx. 1.5 to 2.5 parts by weight;

Sodium tetraborate: approx. 0.3 to 0.5 parts by weight;

Magnesium oxide: approx. 0.15 to 0.25 parts by weight.

We claim:

1. A gas-filled discharge lamp assembly, comprising:

at least two electrodes forming a discharge gap therebetween;

an amount of electrode activation compound on at least one of said electrodes;

said electrode activation compound containing base components of sodium silicate ($Na_2SiO_3$), cesium silicate ($Cs_2SiO_3$), and metallic titanium (Ti), and additional base components of potassium silicate ($K_2SiO_3$) and cesium tungstate ($Cs_2WO_4$); said additional base components reducing a proportion of the said sodium silicate ($Na_2SiO_3$); and additives in relatively smaller proportions of sodium tetraborate ($Na_2B_4O_7$) and magnesium oxide (MgO).

2. The discharge gap assembly according to claim 1, wherein said base components are contained in said electrode activation compound in an amount of approximately 1 to 3 parts by weight each, and said additives are contained in said electrode activation compound in an amount of approximately 0.1 to 0.5 parts by weight each.

* * * * *